US005694797A

United States Patent [19]

Kuo

[11] Patent Number: 5,694,797

[45] Date of Patent: Dec. 9, 1997

[54] LOCKING DEVICE FOR MOTORCYCLE

[76] Inventor: Li-Tsao Kuo, No. 47-8, Alley 36, Lane 459, Sec. 1, An-Ho Rd., Tainan City, Taiwan

[21] Appl. No.: 688,962

[22] Filed: Jul. 31, 1996

[51] Int. Cl.[6] ..... E05B 67/06

[52] U.S. Cl. ..... 70/53; 70/39

[58] Field of Search ..... 70/53, 39, 38 R, 70/38 C, 24, 26, 25

[56] References Cited

U.S. PATENT DOCUMENTS

| | | | |
|---|---|---|---|
| 598,656 | 2/1898 | De Colton | 70/49 |
| 2,924,960 | 2/1960 | Palazzo | 70/53 |
| 4,918,971 | 4/1990 | Kavizky | 70/53 |
| 5,406,811 | 4/1995 | Nakai | 70/53 |
| 5,433,092 | 7/1995 | Kuo | 70/53 |
| 5,475,993 | 12/1995 | Kuo | 70/53 |

*Primary Examiner*—Darnell M. Boucher

*Attorney, Agent, or Firm*—Morton J. Rosenberg; David I. Klein

[57] ABSTRACT

The present invention provides a locking device for motorcycle which includes a lock barrel and a collapsible latch hook. The latch hook is composed of two feet in that the upper portions are bent segments and the the bottom portions are vertical segments, and the two feet can pivot on a vertical trunnion horizontally. The feature of the present invention is that the two feet have a corresponding diversity bending angle on the bent segments so that the shafts of the feet close together as standing side by side.

1 Claim, 5 Drawing Sheets

LOCKING DEVICE FOR MOTORCYCLE

FIELD OF THE INVENTION

The present invention relates to a locking device for motorcycle, and more particularly to a foldable lock.

BACKGROUND OF THE PRIOR ART

Due to the motorcycle theft has been increasing tremendously in recent years, the demand for an antitheft lock of motorcycle has drawn attention to the inventors. A further consideration is that most motorcycle has a very limited storing space, the new designed locking device will have to be a compact and more reliable model. The prior art locking device, as shown in FIG. 5, is essentially composed of a collapsible latch hook, in which one ends of two half latch hooks are linked together with a trunnion so that they can pivot on the trunnion to fold or unfold. But the size of the lock is still too big to be stored.

OBJECTS AND SUMMARY OF THE INVENTION

It is the primary object of the present invention to provide an improved foldable locking device for motorcycle which can be collapsed at the two feet of a latch hook to decrease the storing space to the minimum.

It is another object of the present invention to provide an improve foldable locking device for motorcycle which is easy to operate and more secure.

DETAILED DESCRIPTION OF THE PREFERRED EMBODIMENT

Figure 1:
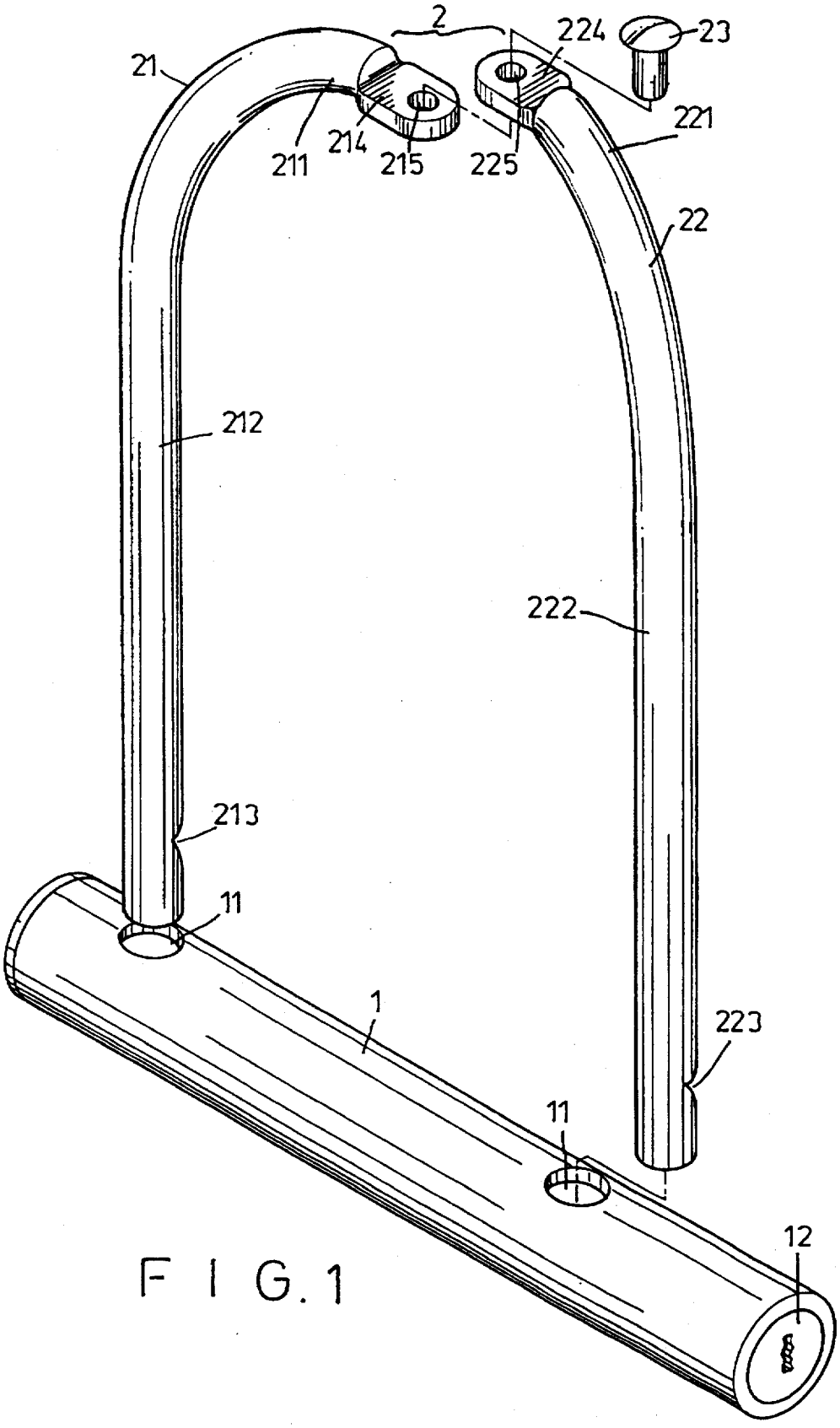
FIG. 1 is an exploded view of the present invention.
Figure 2:
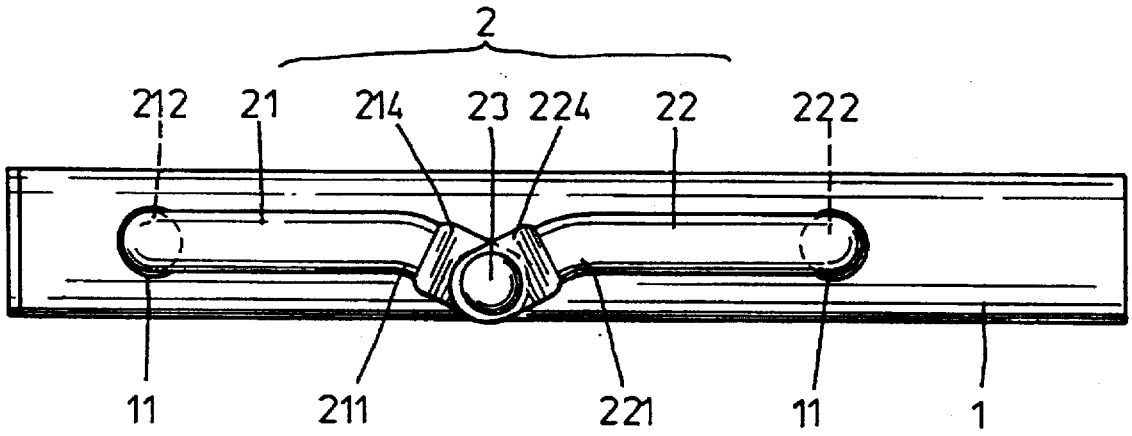
FIG. 2 is a top view of the present invention.

Referring to FIG. 1 and FIG. 2, the present invention The lock barrel 1 has two sockets 11 on the top side for the latch hook 2 plugging in, and a lock core 12 secured in the inner portion at one end thereof.

The latch hook 2 is composed of two feet 21 & 22, each of the feet 21 and 22 has a bent segments 211 and 221 on each upper part, and a vertical segments 212 and 222 extending downwardly from the bent segments 211 and 221, and a notches 213 and 223 at the bottom portions of each foot for the bayonet catching in the lock barrel 1 to form a locked state. Two level flat segments 214 and 224 are formed on the top ends thereof, and two through-holes 215 and 225 are located at the center portions of the level flat segments 214 and 224 for a trunnion 23 riveting therein.

Figure 3:
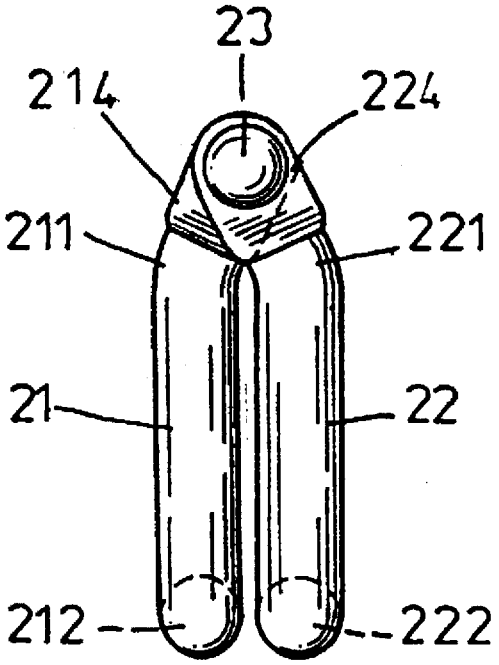
FIG. 3 is a top view of a latch hook of the present invention, in a folding state.
Figure 4:
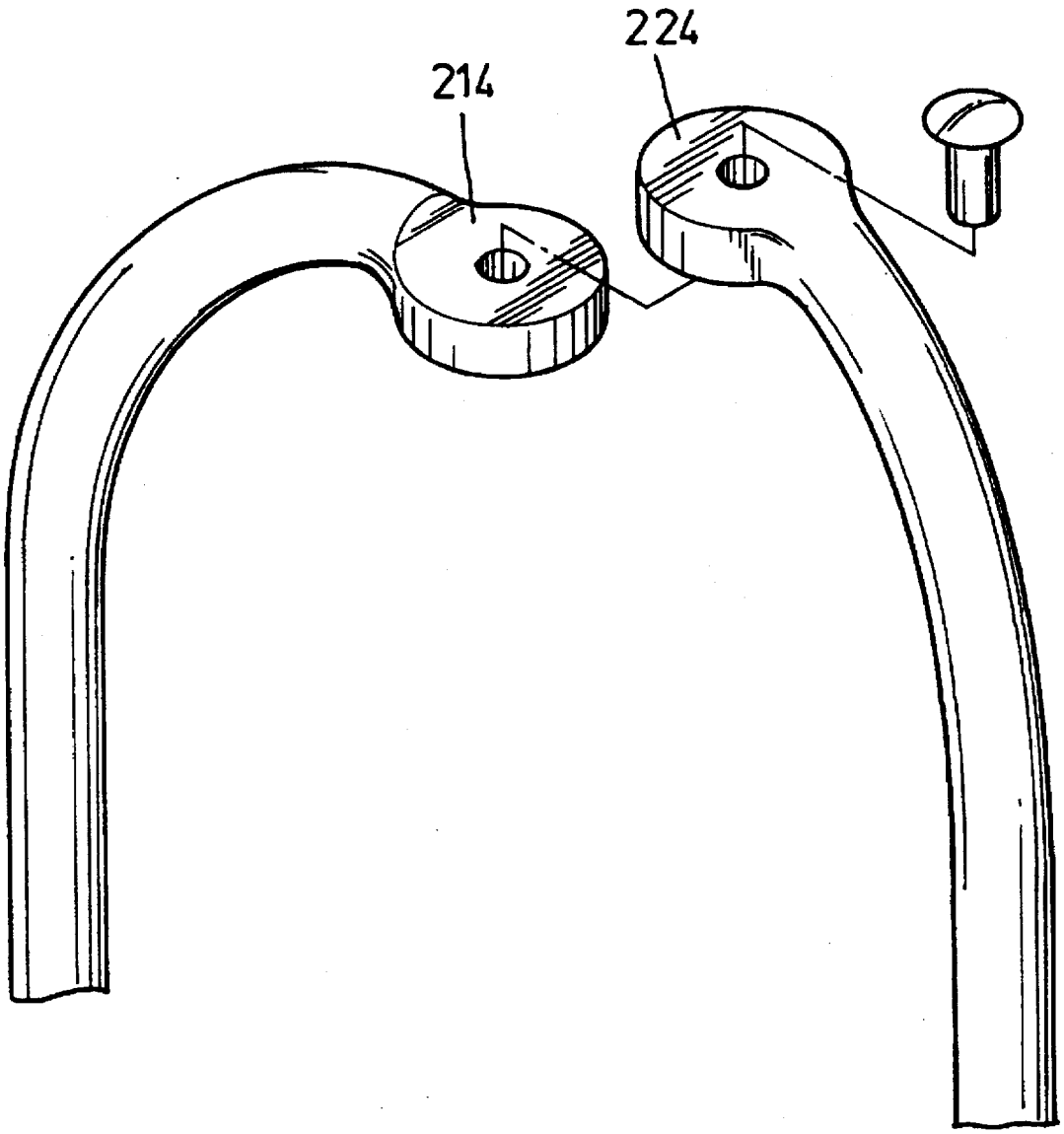
FIG. 4 is an exploded view showing the latch hook of the present invention.
Figure 5:
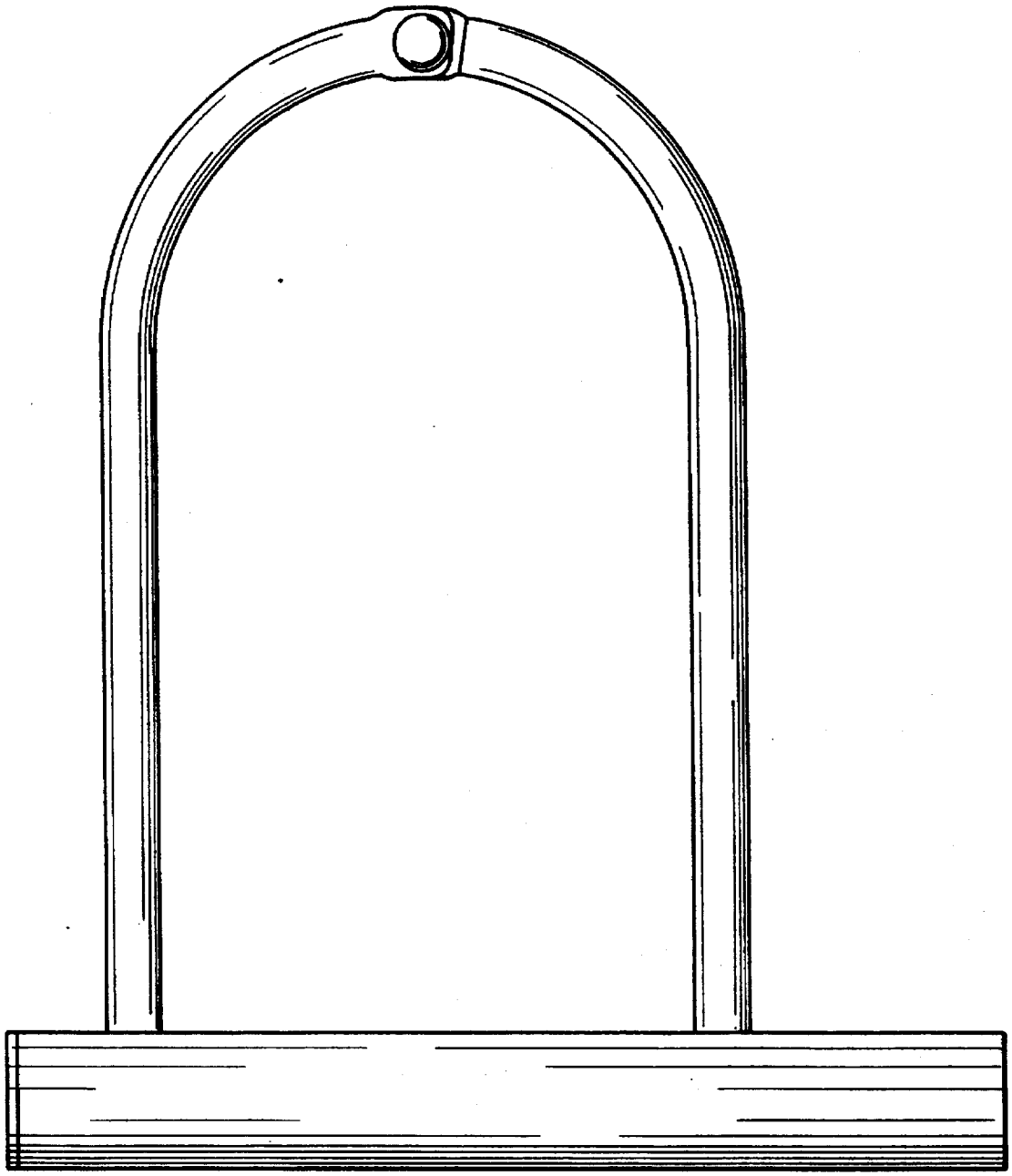
FIG. 5 (PRIOR ART)
FIG. 5 is a side view of a prior folded lock.

In mounting and practicing, as showing in FIG. 2, spread the two feet 21 and 22 widely open and plug the end portions into the sockets 11 of the lock barrel 1 and the notches 213 and 223 will engage with bayonet catches (not shown in the drawings), thus confining withdrawn of the two feet 21 and 22 from the sockets 11 of the lock barrel 1. The bending portions 211 and 221 have been intentionally deviated from the axis of the lock barrel 1 in such that the pin joint point of the feet 21 and 22 deviates an angle from the axis of the lock barrel 1. This deviation does not affect the antitheft function, but enables the latch hook 2 to be collapsed to a relatively small size when the two feet 21 and 22 are folded, as showing in FIG. 3 for storing in a compact box at the rear end of a motorcycle, due to there are said corresponding bent angles on the bent segments 211 221, the feet 21 and 22 can be folded in a side by side state, further to decrease the volume of space occupied by the latch hook 2 to the most minimal for storing in the rear box easily. The flat segments 214 & 224 can be also formed into a flat circular shape, as shown in FIG. 4.

I claim:

1. A locking device for a motorcycle comprising:

(a) a longitudinally extending lock barrel having a longitudinally extending axis, said lock barrel having a lock core positioned within one end thereof; and, (b) a latch hook formed of a pair of vertically directed foot members, each of said foot members having a bottom section for insert into respective sockets formed in said lock barrel, each of said foot members having an arcuately contoured top section, each of said top sections having a flattened end segment with respective vertically directed aligned through openings formed therethrough for insert of a trunnion to provide rotational pivoting of said foot members about a vertical axis, each of said flattened end segments forming an obtuse angle with respect to said longitudinal axis whereby said foot members are rotatable into a collapsed side by side relation.

* * * * *